US006273382B1

(12) United States Patent
Pemberton

(10) Patent No.: US 6,273,382 B1
(45) Date of Patent: Aug. 14, 2001

(54) ADJUSTABLE TILT-DOWN KEYBOARD SUPPORT DEVICE

(76) Inventor: Gregory L. Pemberton, 1549 E. Tudor Rd., Anchorage, AK (US) 99507

( * ) Notice: Subject to any disclaimer, the term of this patent is extended or adjusted under 35 U.S.C. 154(b) by 0 days.

(21) Appl. No.: 09/409,254

(22) Filed: Sep. 30, 1999

(51) Int. Cl.[7] ..... B43L 15/00

(52) U.S. Cl. ..... 248/286.1; 248/118.1; 248/281.11; 248/292.14

(58) Field of Search ..... 248/286.1, 918–923, 248/118.1, 118.3, 287.1, 291.1, 281.13–292.14, 284.1; 108/1, 7–9; 211/151; 312/223.2–223.3, 302, 313, 334.1, 334.4, 334.9, 334.44, 334.46

(56) References Cited

U.S. PATENT DOCUMENTS

| | | | | |
|---|---|---|---|---|
| 4,616,798 | * | 10/1986 | Smeenge et al. | 248/281.1 |
| 4,625,657 | * | 12/1986 | Little et al. | 108/93 |
| 4,691,888 | | 9/1987 | Cotterill . | |
| 5,211,367 | * | 5/1993 | Musculus | 248/288.5 |
| 5,273,250 | | 12/1993 | Pemberton et al. . | |
| 5,292,097 | | 3/1994 | Russell . | |
| 5,351,897 | | 10/1994 | Martin . | |
| 5,377,951 | * | 1/1995 | Johnson et al. | 248/918 |
| 5,405,204 | | 4/1995 | Ambrose . | |
| 5,487,525 | * | 1/1996 | Drabczyk et al. | 248/918 |
| 5,513,579 | | 5/1996 | Allan . | |
| 5,533,820 | | 7/1996 | Ambrose . | |
| 5,626,323 | | 5/1997 | Lechman et al. . | |
| 5,651,524 | * | 7/1997 | Calfee | 248/918 |
| 5,653,413 | | 8/1997 | Fink . | |
| 5,685,235 | | 11/1997 | Allan . | |
| 5,697,303 | | 12/1997 | Allan . | |
| 5,709,489 | | 1/1998 | Ambrose . | |
| 5,722,749 | * | 3/1998 | Domenig | 312/334.4 |
| 5,791,263 | | 8/1998 | Watt et al. . | |
| 5,823,487 | | 10/1998 | Kirchhoff et al. . | |
| 5,836,560 | | 11/1998 | Kaplan et al. . | |
| 5,878,674 | | 3/1999 | Allan . | |
| 5,881,984 | * | 3/1999 | Lin | 248/284.1 |
| 5,924,666 | * | 7/1999 | Liu | 248/286.1 |
| 5,992,810 | * | 11/1999 | Crinion et al. | 248/284.1 |
| 6,076,785 | * | 6/2000 | Oddsen, Jr. | 248/118.3 |
| 6,116,557 | * | 9/2000 | Choy et al. | 248/286.1 |

* cited by examiner

*Primary Examiner*—Daniel P. Stodola
*Assistant Examiner*—Jennifer E. Novosad
(74) *Attorney, Agent, or Firm*—Shlesinger, Arkwright & Garvey LLP

(57) ABSTRACT

A keyboard support device having a structure for being slidably secured to an underside of a desktop. The structure includes first and second side members. First and second tray support side members are vertically adjustably secured to respective structure first and second side members. The tray support side members are positionable between a lowest position and a highest position. A keyboard support is secured to the first and second tray support members. The keyboard support includes a front portion pivotably secured to the tray support members such that the keyboard support can be tilted to a downwardly sloping position away from the front portion while the vertical position of the front portion remains substantially the same.

21 Claims, 3 Drawing Sheets

ADJUSTABLE TILT-DOWN KEYBOARD SUPPORT DEVICE

FIELD OF THE INVENTION

The present invention relates to an ergonomic support device for a keyboard apparatus or the like.

BACKGROUND OF THE INVENTION

Carpal tunnel syndrome is manifested by numbness, tingling and pain in hand and fingers of the user and may be caused by improper computer keyboard positioning relative to the posture of the user. Prevention of carpal tunnel syndrome has become important with the widespread use of personal computers in the office environment. With increased productivity due to increased typing speeds and elimination of non-productive hand movements previously required in using an electric typewriter, such as manual error corrections, carriage return, replacing paper, more forceful actuation of the keys, etc., the incidence of carpal tunnel syndrome appears to have increased.

It has been found that proper orientation of the keyboard relative to the user's forearms, wrist and fingers may mitigate the occurrence of carpal tunnel syndrome.

Adjustable keyboard support devices are well known in the art. For example, U.S. Pat. No. 5,273,250, issued to Pemberton et al., discloses a keyboard support apparatus that allows the inclination of the keyboard to be adjusted downwardly relative to the user. However, the apparatus does not allow for vertical adjustment of the keyboard other than what is afforded by the tilt adjustment.

OBJECTS AND SUMMARY OF THE INVENTION

It is an object of the present invention to provide an adjustable keyboard support device where the height and the tilt of the keyboard can be adjusted independently of the other adjustment.

It is another object of the present invention to provide an adjustable keyboard support device where the keyboard can be tilted downwardly away from the user for a more natural and comfortable positioning of the user's fingers, wrist and forearms.

It is still another object of the present invention to provide an adjustable keyboard support device that keeps the vertical position of the device constant while adjustment to the tilt is made, thereby minimizing adjustment iterations between the vertical and the tilt adjustments.

It is an object of the present invention to provide an adjustable keyboard support device that can be stored out of the way underneath a desktop when not in use.

It is another object of the present invention to provide an adjustable keyboard support device that can be relatively easily retrofitted to an existing desk or workstation.

It is still another object of the present invention to provide an adjustable keyboard support device that minimizes the flexing of the user's wrist, thereby minimizing the onset of carpal tunnel syndrome.

It is an object of the present invention to provide an adjustable keyboard support device that provides the user support for the whole arm during pauses and keying operation.

In summary, the present invention provides a keyboard support device comprising a structure for being slidably secured to an underside of a desktop. The structure includes first and second side members. First and second tray support side members are vertically adjustably secured to respective structure first and second side members, the tray support side members being positionable between a lowest position to a highest position. A keyboard support is secured to the first and second tray support members. The keyboard support includes a front portion pivotably secured to the tray support members such that the keyboard support can be tilted to a downwardly sloping position away from a user while the vertical position of the front portion remains substantially the same.

DETAILED DESCRIPTION OF THE INVENTION

Figure 1:
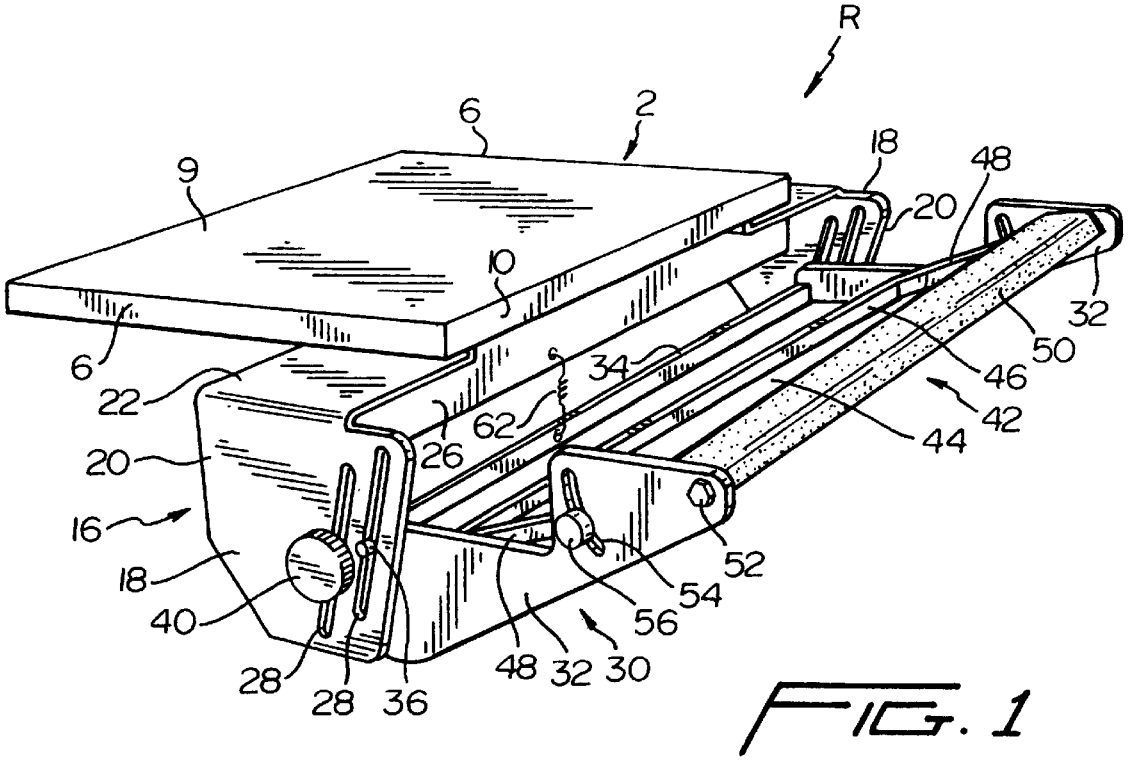
FIG. 1 is perspective view of an adjustable keyboard support device made in accordance with the present invention.
Figure 2:
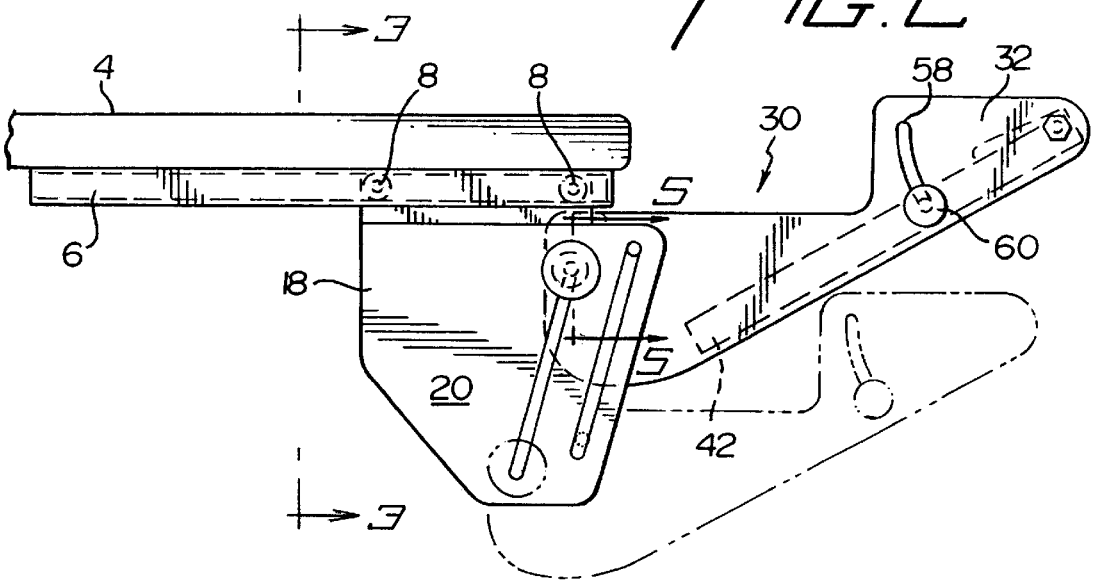
FIG. 2 is a side elevational view of FIG. 1, showing the device secured to an underside of a worksurface and showing the vertical adjustability of the device.
Figure 3:
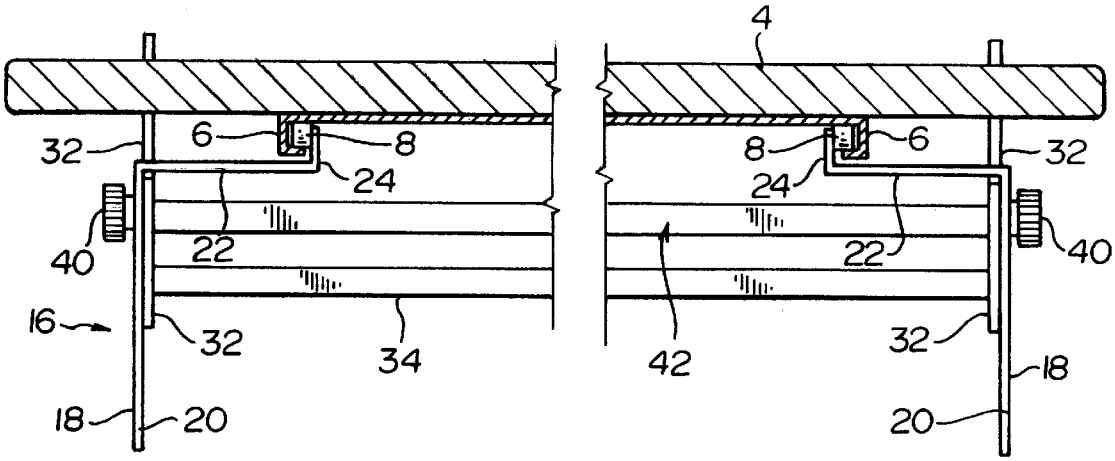
FIG. 3 is a cross-sectional view taken along line 3—3 of FIG. 2.

A keyboard support device R made in accordance with the present invention is disclosed in FIG. 1. The device R includes a stationary frame 2 for being secured to a support structure, such as the underside of a desk 4, as best shown in FIG. 2. The frame 2 includes a pair of tracks 6 for receiving therein a plurality of rollers 8, as best shown in FIGS. 2 and 3. The frame 2 includes a mounting base 9 that advantageously keeps the tracks 6 aligned to each other for simplified installation. The frame 2 may be formed from a single sheet of metal or other suitable materials.

Figure 4A:
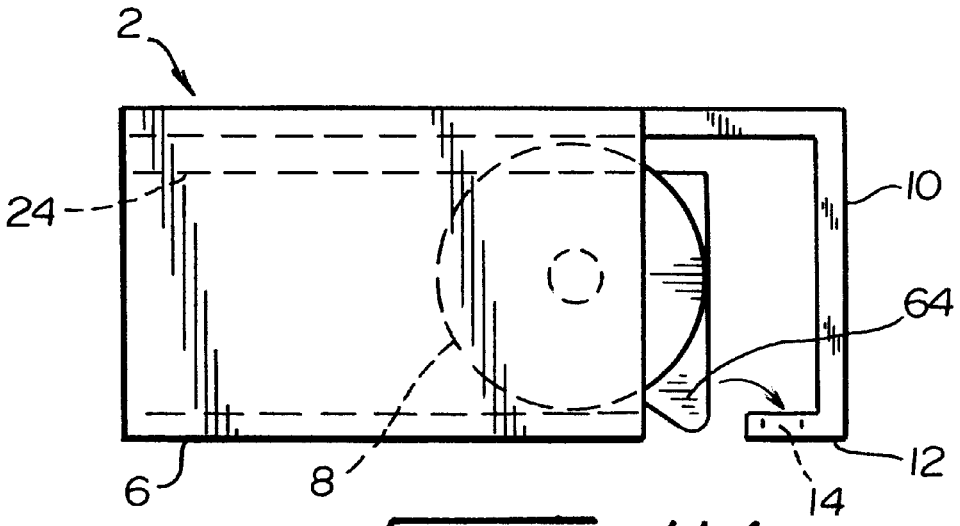
FIGS. 4A and 4B are enlarged detail views of a lock to keep the device in place when in use.
Figure 4B:
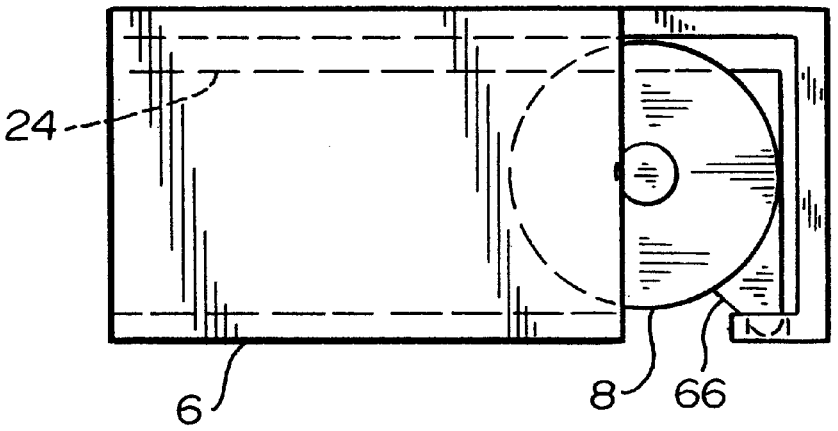

A front portion of the frame 2 includes an L-shaped section 10 that provides a stop to the forward motion of the rollers 8, as best shown in FIGS. 4A and 4B. A horizontal flange 12 forming part of the L-shaped section includes a pair of openings 14, each disposed at opposite ends. The openings 12 are used to keep the device from sliding along the tracks 8 when in use, as will be described herein.

Referring to FIGS. 2 and 3, a support structure 16 is supported by the rollers 8. The structure 16 includes opposing side members 18, each including a vertical sidewall 20 connected to a horizontal wall 22, which is in turn connected to a vertically extending wall 24. The rollers 8 are pivotally secured to respective vertical walls 24 such that the support structure 16 can freely slide horizontally along the tracks 6. A member 26 interconnects the two sides members 18, as best shown in FIG. 1. Each side wall 20 includes a pair of parallel inclined slots 28, which are aligned with respective slots in the opposite sidewall 20. The support structure 16 may be made from sheet metal, molded plastic or other suitable materials.

Figure 5:
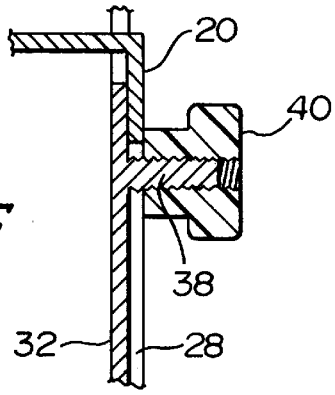
FIG. 5 is a cross-sectional view taken along line 5—5 of FIG. 2.

Vertically adjustable frame 30 is secured to the support structure 16. The frame 30 includes a pair of sidewalls 32 connected to each other with a member 34. Each sidewall 32 includes a pin 36 and a threaded rod 38, both extending outwardly from respective sidewall and received within respective slots 28, as best shown in FIGS. 1 and 5. An internally threaded knob 40 cooperates with the respective threaded rod 38 to provide clamping pressure to lock the frame 30 at any desired location along the length of the slots 28, between a most vertical position and a least vertical position, shown in solid and phantom lines, respectively, in FIG. 2. The frame 30 may be made of sheet metal, molded plastic or other suitable materials.

A tray 42 configured to receive and support a computer keyboard (not shown) is secured between the two sidewalls 32, as best shown in FIGS. 1 and 3. The tray 42 includes a platform 44, a rear sidewall 46 and end walls 48. The tray 42 may be made of sheet metal, molded plastic or other suitable materials. An auxiliary support 50 is disposed along the rear end of the tray 42 to provide support to the user's wrists and forearms. The auxiliary support 50 is preferably made of resilient material, such as rubber, foam or other suitable materials.

The tray 42 is secured to the frame 30 by means of pivots 52, one on each side of the sidewalls 32. A threaded rod extends outwardly from each end wall 48 and is received within respective arcuate slots 54 in the respective sidewall 32, similar to that shown in FIG. 5. Each slot 52 has the same radius about the each pivot 52 to allow the tray 42 to tilt about the pivots 52. Internally threaded knobs 56 provide clamping action to lock the tray 42 at any desired angular tilt bounded by the end limits of the arcuate slots 54. The tray 42 can be positioned substantially horizontally when the threaded rods are located at the top ends 58 of the arcuate slots 54, as best shown in FIG. 2, or at its maximum tilt when the threaded rods are at the bottom end 60 of the arcuate slots 54, or any position in between. The tray 42 may be made from sheet metal, molded plastic or other suitable materials.

A spring 62 secured between the member 26 and 34 provides sufficient counterbalance to the weight of the frame 30, the tray 42 and the keyboard (not shown) so that when the knobs 40 are loosened to adjust the support 30 vertically, the support 30 would not suddenly drop down in case it was previously positioned at its upper location and that the user would not have to support the entire weight of the structure.

In operation, the knobs 40 are loosened when it is desired to change the vertical position of the keyboard. When the proper height is attained with reference to the rear portion of the tray 42, the knobs 40 are then tightened to lock in place the frame 30. To adjust the tilt of the keyboard, the knobs 56 are loosened and the tray 42 is pivoted about the pivots 52 until the desired tilt is obtained. The knobs 52 are then tightened to lock in place the tray 42 at the desired tilt. It will be apparent that during adjustment, once the vertical height of the auxiliary support 50 is fixed by the user, no further vertical adjustment will be necessary after the tilt of the tray 42 has been adjusted. The independent vertical and tilt adjustments advantageously avoid the inconvenience of a prior art device which uses combined vertical and tilt adjustments, wherein adjusting the vertical or tilt position would automatically change the other position, whether or not desired by the user, requiring further adjustments to be made.

Referring to FIGS. 4A and 4B, each wall 24 has a triangular corner 64 adapted to be received within the respective opening 14 to lock the support structure 16 relative to the tracks 6 and prevent it from rolling horizontally during use. The support structure 16 is slightly lifted upwardly at the end of its rearward travel toward the user to place the triangular portion 64 into the respective opening 14, as best shown in FIG. 4B. To stow the carriage below the desktop, the carriage is merely pushed forward, causing the sloping edge 66 of the triangular portion to lift the triangular portions 64 and, therefore, the carriage from the openings 14.

The threaded rod 38 and the corresponding pin 36 define an imaginary line between them that is inclined upwardly towards the user, affording a greater distance between them than the separation of the slots would allow. This feature advantageously provides resistance against rotation during use and adjustment. Since the frame 30 is cantilevered from the support structure 16, there is rotational tendency about the support structure 16 whenever weight, such as the user's forearms, is imposed on the frame 30. By being inclined upwardly toward the user, the weight of the structure and any other force imposed on it during use will generate frictional forces between the pin and the front wall (toward the user) of the respective slot 28, thereby helping to hold the frame 30 in place.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A keyboard tray support device, comprising:

a) a structure for being slidably secured to an underside of a desktop, said structure including first and second side members;

b) first and second tray support side members vertically adjustably secured to respective said structure first and second side members, said tray support side members being positionable between a lowest position and a highest position; and c) a keyboard support secured to said first and second tray support members, said keyboard support including a front portion pivotably secured to said tray support side members such that said keyboard support can be tilted to a downwardly sloping position away from said front portion while the vertical position of said front portion remains substantially the same.

2. A keyboard tray support device as in claim 1, wherein:

a) each of said structure first and second side members includes a pair of parallel inclined guides; and b) respective first and second tray support side members are secured to respective said guides.

3. A keyboard tray support device as in claim 2, wherein said guides are disposed along a slope oriented toward the front portion.

4. A keyboard tray support device as in claim 2, wherein said pair of guides comprises a respective pair of slots.

5. A keyboard tray support device as in claim 1, wherein said first and second tray support side members include an arcuate guide having a radius about a pivot.

6. A keyboard tray support device as in claim 5, wherein said arcuate guide comprises a slot.

7. A keyboard tray support device as in claim 6, and further comprising a threaded rod and a pin extending outwardly from each of said first and second tray support side members.

8. A keyboard tray support device as in claim 7, wherein said threaded rod and said pin define a line sloping upwardly toward said front portion.

9. A keyboard tray support device as in claim 1, and further comprising:

a) a stationary member including a pair of tracks and a plurality of rollers disposed in said tracks; and b) said structure is carried by said rollers.

10. A keyboard tray support device as in claim 9, wherein:

a) said stationary member includes a front portion having a horizontal flange;

b) said flange includes an opening; and c) said structure includes a triangular portion configured to be received in said opening.

11. A keyboard tray support device as in claim 1, wherein said tray support side members are cantilevered from said structure.

12. A keyboard support device, comprising:

a) a structure for being slidably secured to an underside of a desktop, said structure including first and second side members each including first and second upwardly sloping parallel slots;

b) first and second tray support side members vertically adjustably secured to respective said structure first and second side members, said tray support side members being positionable between a lowest position and a highest position;

c) each of said tray support side members including a threaded rod and a pin received within respective said first and second slots;

d) a threaded knob cooperating with each said threaded rod to clamp respective said structure side members to respective said tray support side members;

e) a keyboard support secured to said first and second tray support members; and f) said threaded rod and said pin defining an upwardly sloping line between them.

13. A keyboard tray support device as in claim 12, wherein said keyboard support is adjustably pivotably secured to said tray support members.

14. A keyboard tray support device as in claim 12, wherein:

a) said keyboard support includes a front portion; and b) a pivot for securing said front portion to said tray support first and second side members.

15. A keyboard tray support device as in claim 14, wherein:

a) each said tray support side member includes an arcuate guide having a radius about said pivot; and b) said tray support is adjustably secured along said arcuate guide.

16. A keyboard tray support device as in claim 15, wherein said arcuate guide comprises a slot.

17. A keyboard tray support device as in claim 14, and further comprising an auxiliary support disposed at said front portion.

18. A keyboard tray support device for supporting a keyboard, comprising:

a) a pair of tracks including a plurality of rollers, said tracks for being secured to an underside of a desktop;

b) a structure for supporting the keyboard, said structure being operably secured to said rollers such that said structure is horizontally movable from a first position wherein said structure is disposed toward a rear portion of said tracks and a second position wherein said structure is disposed toward a front portion of said tracks;

c) an L-shaped member disposed adjacent said front portion of said tracks to provide a stop to said rollers when said structure is pulled to said second position;

d) said L-shaped member including a base portion including an opening; and e) said structure including a triangular portion having a corner configured to be received within said opening to lock said structure at said second position.

19. A keyboard tray support device as in claim 18, wherein said triangular portion includes a sloping edge configured to cooperate with an edge of said opening to lift said structure out of said opening when said structure is pushed toward said first position.

20. A keyboard tray support device as in claim 18, wherein a base is secured to said pair of tracks.

21. A keyboard tray support device as in claim 20, wherein said tracks and said base are integral.

* * * * *